US005605040A

United States Patent [19]

Cullen et al.

[11] Patent Number: 5,605,040

[45] Date of Patent: Feb. 25, 1997

[54] INFERRING TEMPERATURE OF A HEATED EXHAUST GAS OXYGEN SENSOR

[75] Inventors: Michael J. Cullen, Northville; Paul F. Smith, Dearborn Heights; Thomas S. Gee, Canton, all of Mich.

[73] Assignee: Ford Motor Company, Dearborn, Mich.

[21] Appl. No.: 412,663

[22] Filed: Mar. 29, 1995

[51] Int. Cl.[6] ..... F01N 3/20

[52] U.S. Cl. ..... 60/274; 60/276; 60/285; 123/697

[58] Field of Search ..... 60/274, 276, 285; 123/697

[56] References Cited

U.S. PATENT DOCUMENTS 5,167,120 12/1992 Junginger ..... 123/697
5,291,673 3/1994 Hamburg ..... 123/697

*Primary Examiner*—Douglas Hart
*Attorney, Agent, or Firm*—Peter Abolins

[57] ABSTRACT

A method of inferring the temperature of a heated exhaust gas oxygen sensor is used in the control of the operation of an electronic engine control for an internal combustion engine.

19 Claims, 2 Drawing Sheets

INFERRING TEMPERATURE OF A HEATED EXHAUST GAS OXYGEN SENSOR

BACKGROUND OF THE INVENTION

1. Field of the Invention

This invention relates to electronic engine controls for operation of an internal combustion engine.

2. Prior Art

It is known to control the air fuel ratio of an internal combustion engine using various air fuel control strategies. Factors such as ambient air pressure, mass air flow, and intake air temperature have been used in the process of controlling air fuel ratio for an internal combustion engine.

Further, the proper operation of a catalyst processing the exhaust gas from an internal combustion engine depends, in part, upon the air fuel ratio supplied to the engine. Associated with the downstream flow of exhaust gas and the catalyst it is known to use an exhaust gas oxygen sensor to sense the concentration of oxygen in the exhaust gas. Knowledge of the exhaust gas oxygen concentration can be used to control the air fuel ratio.

Previous approaches have used exhaust gas temperature prediction strategy based upon the catalyst midbed temperature in the exhaust gas.

It would be desirable to improve control of the air fuel ratio in an engine by better taking into account the operating conditions of the engine, including exhaust gas oxygen sensor temperature.

SUMMARY OF THE INVENTION

This invention recognizes that exhaust gas oxygen sensor temperature can be inferred. If desired, the temperature can be used to implement adjustments to engine control that would improve overall performance of the engine.

The invention also takes into account that the heated exhaust gas oxygen sensor has its own time constant for temperature changes since it has its own thermal capacitance. This time constant has been found to be a function of the exhaust gas flow rate which equals the air mass flow rate, AM.

The invention further recognizes that the exhaust gas oxygen sensor temperature can have a temperature offset from the exhaust gas temperature since part of the exhaust gas oxygen sensor assembly is exposed to the atmosphere and part to the metal exhaust pipe.

This invention further recognizes that knowledge of the exhaust gas oxygen sensor temperature can have at least two purposes:

1) determining when water vapor is no longer present near the exhaust gas oxygen sensor so the heater can be turned on without ceramic cracking, 2) deciding when to turn the heater off to protect it from over temperature.

DETAILED DESCRIPTION OF THE DISCLOSURE

Figure 1:
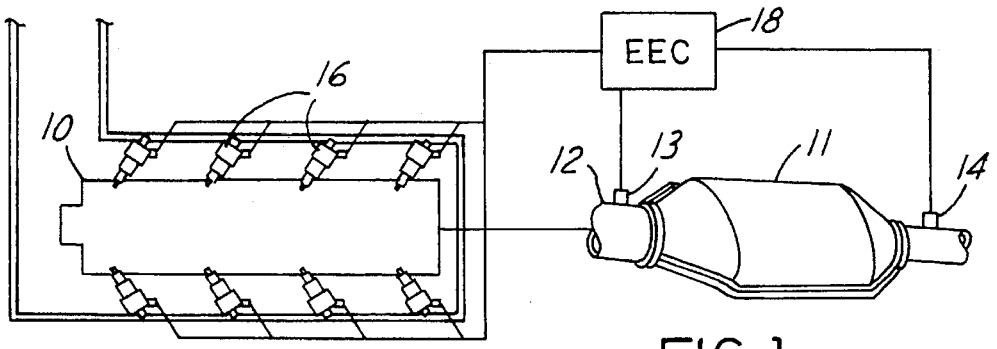
FIG. 1 is a block diagram of an engine and control system in accordance with an embodiment of this invention.

Referring to FIG. 1, an engine 10 has an exhaust gas path 12 coupled to a catalyst 11. An exhaust gas oxygen (EGO) sensor 13, including a heater, is positioned in the exhaust gas flow upstream of catalyst 11 and an exhaust gas oxygen sensor 14, including a heater, is positioned in the exhaust gas flow downstream of catalyst 11. Associated with each sensor 13 and 14 is a resistance heater for providing selective heating of sensors 13 and 14. Output signals from sensors 13 and 14 are applied to an electronic engine control (EEC) module 18 which contains an engine control strategy and produces an output applied to fuel injector 16, which controls fuel injection into engine 10.

When the engine is started a timing sensor associated with an engine electronic engine control (EEC) system indicates the time since the vehicle was last turned off and this value is stored in SOAKTIME, the magnitude representing seconds. The front EGO sensor tip temperature EXT_FET (Front Ego sensor Tip) is modelled as the sum at the unheated tip temperature EXT_FEU (Front Ego sensor Unheated) and the effect of the electrical resistance heater EXT_FEH (Front Ego sensor Heat).

In initialization, each of these components is assumed to cool off with a first order time constant. The EEC exponential function FNEXP is used to predict the temperature components at any time SOAKTIME after the car was turned off. The temperature components value at car turn off are stored in keep alive memory KAM. INFAMB is the inferred or measured ambient temperature. Analogous logic is used for the rear EGO sensor tip temperature.

Figure 2A:
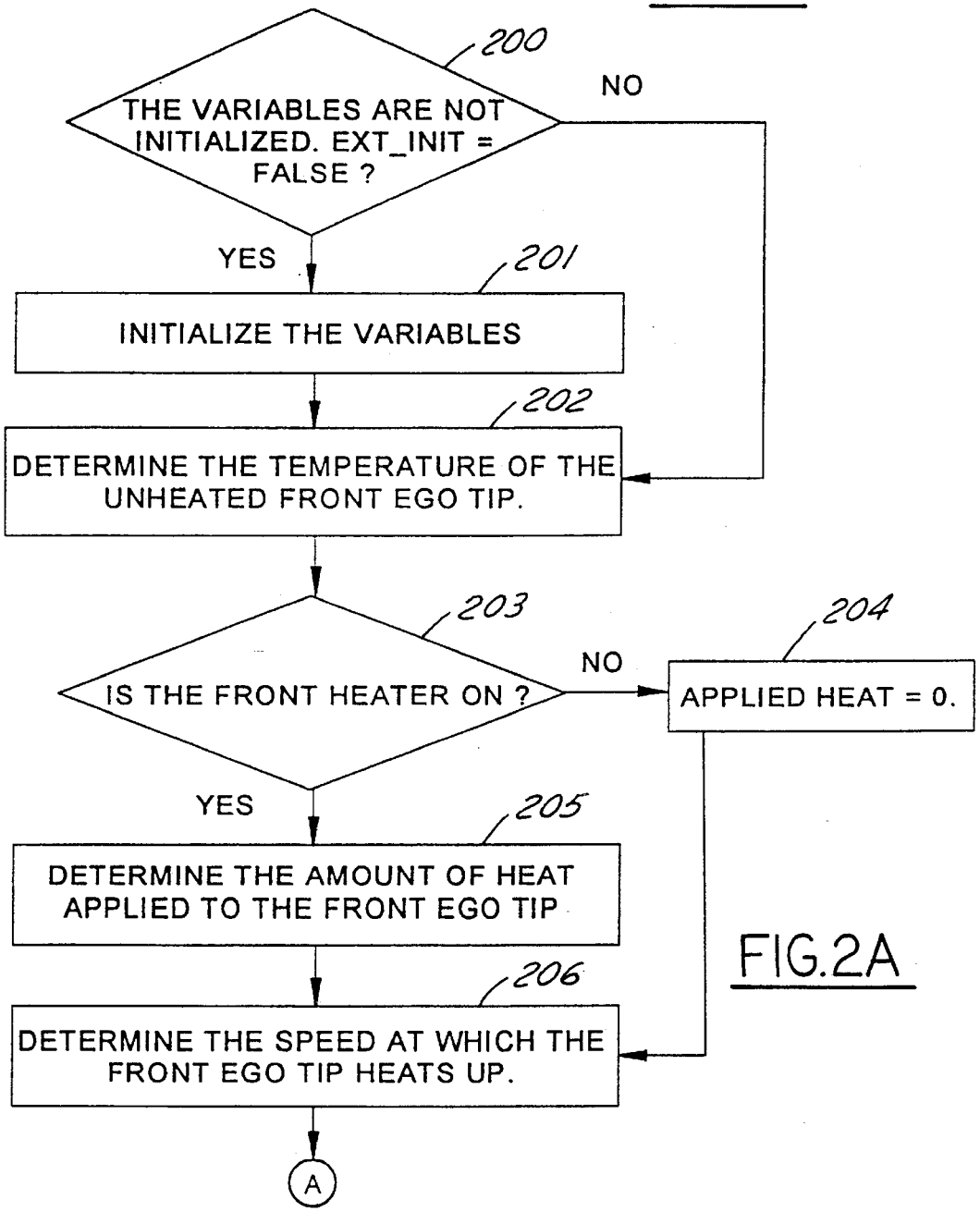
FIGS. 2A and 2B are a logic flow chart in accordance with an embodiment of this invention.
Figure 2B:
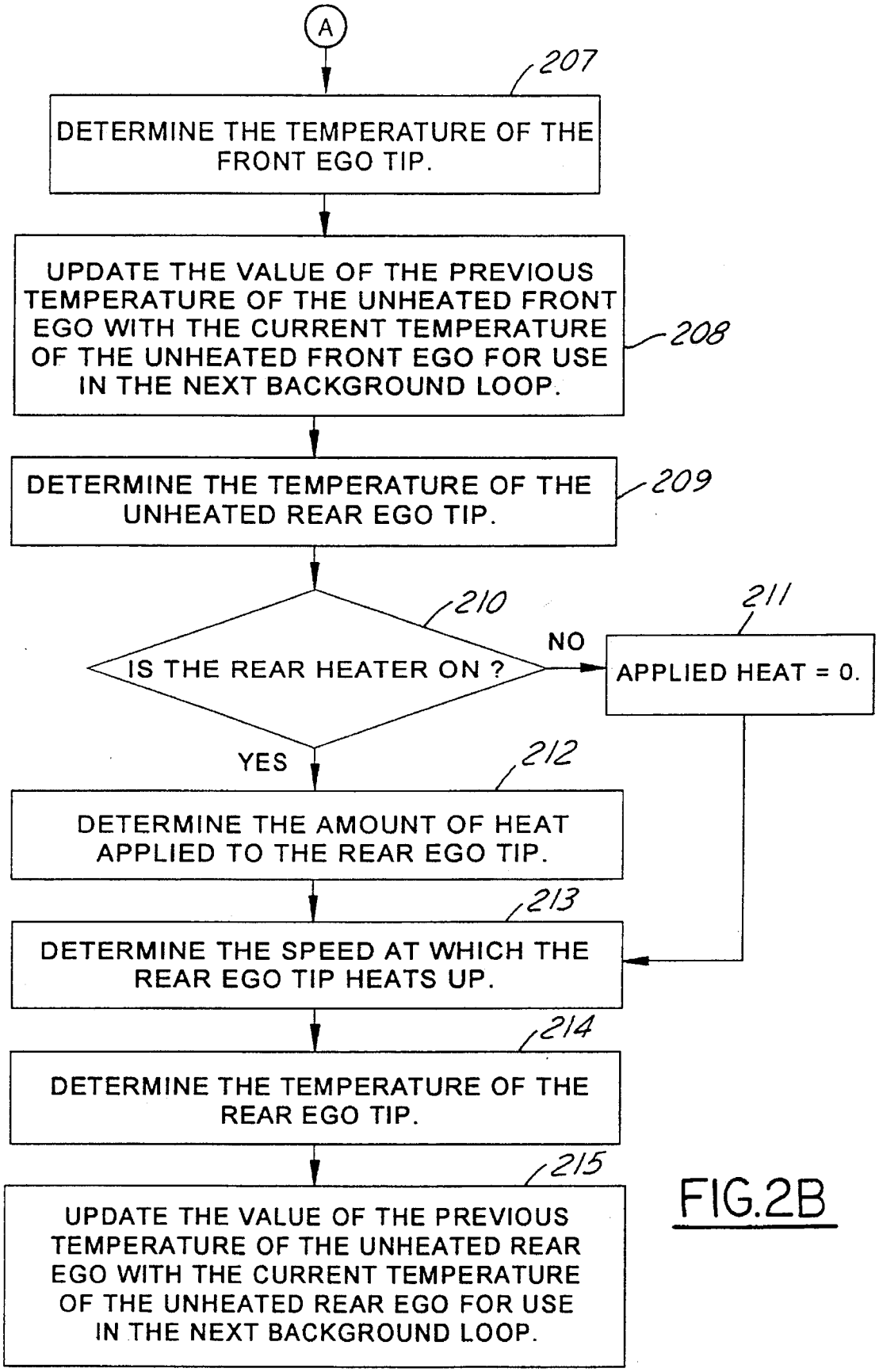

Referring to FIGS. 2A and 2B, the method of inferring temperature of a heated exhaust gas oxygen sensor starts at a decision block 200 wherein it is asked whether a variable has been initialized. EXT_INIT is a boolean variable that is set to FALSE by the EEC only once, during the first background loop of engine strategy operation. If at decision block 200, EXT_INIT does not equal FALSE, the initialization process is skipped and the logic flow continues on to a block 202. If EXT_INIT equals FALSE, logic flow goes on to a block 201 wherein the variables are initialized.

The temperature in degrees of unheated front exhaust gas oxygen sensor 13 (EXT_FEU) is determined by the following formula: INFAMB+FNEXP(−SOAKTIME/TC_SOAK_FEU) * (EXT_FEU_PREV−INFAMB) where INFAMB is the inferred ambient temperature in degrees, FNEXP(x) is a lookup table representing the constant e raised to the x, SOAKTIME is the amount of time in seconds that has lapsed since the engine was last turned off, TC_SOAK_FEU is a calibrateable time constant in degrees per second that describes the speed at which unheated front EGO sensor 13 (EXT_FEU) will cool off after the engine is turned off and EXT_FEU_PREV is the temperature in degrees of unheated front EGO sensor 13 from the previous background loop, before the engine was last turned off. The effect of the heat in degrees that has been applied by the resistance heater to front EGO sensor 13 (EXT_FEH) is determined by the following formula: INFAMB+FNEXP(−SOAKTIME/TC_SOAK_FEH) * (EXT_FEH_PREV−INFAMB) where TC_SOAK_FEH is a calibrateable time constant in degrees per second that describes the speed at which the heat applied to front EGO sensor 13 will dissipate and EXT_FEH_PREV is the effect of the heat in degrees that was applied during the previous background loop.

The temperature in degrees of the tip of front EGO sensor 13 (EXT_FET) is determined by the following formula:

EXT_FEU+EXT_FEH. The temperature in degrees of unheated rear EGO sensor 14 (EXT_REU) is determined by the following formula: INFAMB+FNEXP(−SOAKTIME/TC_SOAK_REU) * (EXT_REU_PREV−INFAMB) where TC_SOAK_REU is a calibrateable constant in degrees per second that describes the speed at which unheated rear EGO sensor 14 (EXT_REU) will cool off after the engine is turned off and EXT_REU_PREV is the temperature in degrees of unheated rear EGO sensor 14 from the previous background loop. The effect of the heat in degrees that has been applied by the resistance heater to rear EGO sensor 14 (EXT_REH) is determined by the following formula: INFAMB+FNEXP(−SOAKTIME/TC_SOAK_REH) * (EXT_REH_PREV−INFAMB) where TC_SOAK_REH is a calibrateable time constant in degrees per second that describes the speed at which the heat applied to rear EGO sensor 14 will dissipate and EXT_REH_PREV is the effect of the heat in degrees that was applied during the previous background loop. The temperature in degrees of the tip of rear EGO sensor 14 (EXT_RET) is determined by the following formula: EXT_REU+EXT_REH. The last step of initialization is to set the "initialized" flag (EXT_INIT) to TRUE.

From block 201 logic goes to block 202 wherein the temperature of unheated front EGO sensor 13 tip (EXT_FEU) is determined. This is done in four steps. The first step is to calculate the temperature loss from the exhaust flange gas temperature to the front EGO sensor 13 temperature (EXT_LS_FEU) using the following formula: FN443L(AM) * [(EXT_FL+EXT_FEU_PREV)/2−INFAMB] where FN443L(AM) is a table of temperature loss versus a temperature difference calculation. The temperature difference is the average of the exhaust flange gas temperature (EXT_FL) and the front EGO sensor 13 tip temperature from the previous background loop (EXT_FEU_PREV) minus the ambient temperature (INFAMB). The second step is to calculate the steady state temperature in degrees of unheated front EGO sensor 13 (EXT_SS_FEU) using the following formula: EXT_FL−EXT_LS_FEU. The third step is to calculate the time constant in degrees per second that describes the speed at which the heat from the exhaust of a running engine will change the temperature of the tip of front EGO sensor 13 (TC_FEU_RUN) by using the function FN443(AM) which determines the time constant for instantaneous front heated gas oxygen sensor (HEGO) wall temperature versus air mass (AM). The fourth step to determining the temperature of unheated front EGO sensor 13 (EXT_FEU) is to calculate the rolling average in degrees of the steady state temperature in degrees of unheated front ego sensor 13 (EXT_SS_FEU). The rolling average is an average value of a parameter of time. One example would be to have a buffer of fixed length (10 registers) which has the value of the parameter placed into it at a fixed time interval (every one second). If a constant value (3) is put into the buffer every one second, in ten seconds, the buffer would be full of 3's and the rolling average would be 3. The buffer works in a first in first out fashion. In fifteen seconds, the first five 3's would have flowed out of the buffer and five seconds worth of new 3's would have flowed in. The rolling average would still be 3. If at 15 seconds, the constant value was changed to 2. At twenty seconds the buffer would contain five 3's and five 2's. The rolling average would be 2.5. At 25 seconds the buffer would contain ten 2's and the rolling average would be 2. The length of the buffer determines how long it will take the rolling average to reach the steady state value. In this example, the steady state value is 2 and the time it took to get there is ten seconds. The length of time required for the rolling average to change 63.2% of the step change is called one time constant (TC) The time constant is calculated by the following formula: 0.632*(old value−new value). In this example, the time constant would be 0.632*(3−2) or 0.623. The buffer model breaks down into the following equation: new rolling average=old rolling average+((new data point−old rolling average)*(1−e**(−t/TC))) where t is the amount of time in seconds that has elapsed.

The EEC does not use a buffer approach. Instead, a rolling average in the form of EXT_FEU=ROLAV(EXT_SS_FEU, TC_REU_RUN) which approximates the above formula is used. The EEC interprets such an instruction to move EXT_FEU from its present value toward EXT_SS_FEU at a time constant of TC_FEU_RUN. An instantaneous value of the front EGO sensor, EXT_FEU, is then calculated as a function of the steady state front EGO temperature EXT_SS_FEU, the time constant of the temperature rise, TC_FEU_RUN and the time required for execution of the background loop, BG_TMR, according to the following relationships: EXT_FEU=(1−FK) * EXT_FEU+FK * EXT_SS_FEU where FK performs an exponential smoothing function according to the following relationship: FK=1/(1+TC_FEU_RUN/BG_TMR).

From block 202, logic flow goes to a decision block 203 wherein it is asked if the front heater in on (FRONT_HEATER_ON). If no, logic flow goes to a block 204 which sets the temperature in degrees of applied heat (EXT_SS_FEH) to 0. Then logic flow continues on to block 206.

If, at decision block 203, the front heater is on, logic flow goes to a block 205 which determines the effect of the heat in degrees that has been applied to the tip of front EGO sensor 13. This is done by using a linear equation versus the EGO temperature in the following formula: EXT_FEH_INT−EXT_FEH_SLP * EXT_FEU where EXT_FEH_INT is the intercept of the applied heat, EXT_FEH_SLP is the slope of the applied heat and EXT_FEU is the temperature in degrees of unheated front EGO sensor 13. As an alternate embodiment of the above formula, one could allow for more complex behavior by having a table look up of the effect of the applied heat (EXT_SS_FEH) versus the temperature of unheated front EGO sensor 13 (EXT_FEU) with piece-wise linear interpolation.

From block 205, logic flow goes to a block 206 wherein the speed in degrees per second at which the tip of front EGO sensor 13 will heat is determined. This is done by setting a calibrateable constant that describes the speed at which front EGO sensor 13 will heat up (TC_FEH_RUN). As an alternate embodiment, this constant could be a look up table versus air mass (AM). Yet another alternate embodiment would be a look up table versus the temperature of unheated front EGO sensor 13 (EXT_FEU). Logic flow then goes to a block 207 which determines the current temperature in degrees of the tip of front EGO sensor 13 (EXT_FET). This is a two step process.

The first step is to calculate the rolling average of the amount of heat that was applied to front EGO sensor 13 by the resistance heater (EXT_SS_FEH). The second step finds the current temperature in degrees of the tip of front EGO sensor 13 (EXT_FET) by adding the temperature in degrees of unheated front EGO sensor 13 (EXT_FEU) and the temperature in degrees of the effect of the heat applied by the resistance heater (EXT_FEH). From block 207, logic flow continues on to a block 208 which updates the previous value of the temperature in degrees of unheated front EGO sensor 13 (EXT_FEU_PREV) with the current value of the temperature in degrees of unheated front EGO sensor 13 (EXT_FEU) for use in the next background loop.

From logic block 208, logic flow goes on to a block 209 wherein the temperature of unheated rear EGO sensor 14 tip (EXT_REU) is determined. This is done in four steps. The first step is to calculate the temperature loss from the catalytic convertor midbed gas temperature to the rear EGO sensor 14 temperature (EXT_LS_REU) using the following formula: FN450L(AM) * [(EXT_CMD+EXT_REU_PREV)/2−INFAMB] where FN450L(AM) is a table of temperature loss versus a temperature difference calculation. The temperature difference is the average of the catalytic converter midbed gas temperature (EXT_CMD) and rear EGO sensor 14 tip temperature from the previous background loop (EXT_REU_PREV) minus the ambient temperature (INFAMB). The second step is to calculate the steady state temperature in degrees of unheated rear EGO sensor 14 (EXT_SS_REU) using the following formula: EXT_CMD−EXT_LS_REU. The third step is to calculate the time constant in degrees per second that describes the speed at which the heat from the exhaust of a running engine will change the temperature of the tip of rear EGO sensor 14 (TC_REU_RUN) by using the function FN450(AM) which determines the time constant for instantaneous rear heated gas oxygen sensor (HEGO) wall temperature versus air mass (AM). The fourth step to determining the temperature of unheated rear EGO sensor 14 (EXT_REU) is to calculate the rolling average in degrees of the steady state temperature in degrees of unheated rear EGO sensor 14 (EXT_SS_REU).

From block 209, logic flow goes to a decision block 210 wherein it is asked if the rear heater is on (REAR_HEATER_ON). If no, logic flow goes to a block 211 which sets the temperature in degrees of applied heat (EXT_SS_REH) to 0. Then logic flow continues on to a block 213. If, at decision block 210, the rear heater is on, logic flow goes to a block 212 which determines the effect of the heat in degrees that has been applied to the tip of rear EGO sensor 14. This is done by using a linear equation versus the EGO temperature in the following formula: EXT_REH_INT−EXT_REH_SLP * EXT_REU where EXT_REH_INT is the intercept of the applied heat, EXT_REH_SLP is the slope of the applied heat and EXT_REU is the temperature in degrees of unheated rear EGO sensor 14. As an alternate embodiment of the above formula, one could allow for more complex behavior by having a table look up of the effect of the applied heat (EXT_SS_REH) versus the temperature of rear EGO sensor 14 (EXT_REU) with piece-wise linear interpolation. From block 212, logic flow goes to a block 213 wherein the speed in degrees per second at which the tip of rear EGO sensor 14 will heat is determined. This is done by setting a calibrateable constant that describes the speed at which rear EGO sensor 14 will heat up (TC_REH_RUN). As an alternate embodiment, this constant could be a look up from a table versus air mass (AM). Yet another alternate embodiment would be a lookup table versus the temperature of rear EGO sensor 14 (EXT_REU).

From block 213, logic flow then goes to a block 214 which determines the current temperature in degrees of the tip of the rear EGO (EXT_RET). This is a two step process. The first step is to calculate the rolling average of the amount of heat that was applied to the rear EGO by the resistance heater (EXT_SS_REH). The second step finds the current temperature in degrees of the tip of rear EGO sensor 14 (EXT_RET) by adding the temperature in degrees of unheated rear EGO sensor 14 (EXT_REU) and the temperature in degrees of the effect of the heat applied by the resistance heater (EXT_REH). From block 214, logic flow continues on to a block 215 which updates the previous value of the temperature in degrees of unheated rear EGO sensor 14 (EXT_REU_PREV) with the current value of the temperature in degrees of unheated rear EGO sensor 14 (EXT_REU) for use in the next background loop.

Various modifications and variations will no doubt occur to those skilled in the arts to which this invention pertains. These and all other variations which basically rely on the teachings through which this disclosure has advanced the art are properly considered within the scope of this invention.

We claim:

1. A method of controlling the operation of an internal combustion engine producing exhaust gas wherein controlling the air to fuel ratio includes the steps of:

establishing an exhaust gas temperature at startup to a function of time since the engine was turned off;

subtracting a temperature offset from the exhaust gas temperature;

calculating a time constant that describes the speed at which an exhaust gas oxygen (EGO) sensor heats up as a function of air mass; and using a rolling average to predict the EGO sensor temperature as a function of said exhaust gas temperature at start-up, said temperature and said time constant.

2. A method of controlling the operation of an internal combustion engine as recited in claim 1 wherein the function of establishing the exhaust gas oxygen sensor temperature includes taking into account an estimate of ambient temperature and the magnitude of the last estimated temperature of said exhaust gas oxygen (EGO) sensor.

3. A method of controlling the operation of an internal combustion engine as recited in claim 2 further including a step of initializing the estimated temperature of a front pre-catalyst exhaust gas oxygen sensor of the internal combustion engine utilizing the following formula: INFAMB+FNEXP(−SOAKTIME/TC_SOAK_FEU) * (EXT_FEU_PREV−INFAMB) where INFAMB is the inferred ambient temperature, SOAKTIME is the amount of time since the engine was last turned off, TC_SOAK_FEU is a calibrateable time constant that describes the speed at which the heat applied to the front pre-catalyst EGO sensor will dissipate, EXT_FEU_PREV is the temperature of the front pre-catalyst EGO sensor in an unheated state from a previous background loop, requiring periodic determination of engine operation parameters, and FNEXP(x) is a lookup table representing the constant e raised to the x.

4. A method of controlling the operation of an internal combustion engine as recited in claim 2 further including initializing the estimated temperature of a rear post-catalyst exhaust gas oxygen sensor of an internal combustion engine utilizing the following formula: INFAMB+FNEXP(−SOAKTIME/TC_SOAK_REU) * (EXT_REU_PREV−INFAMB) where INFAMB is the inferred ambient temperature, SOAKTIME is the amount of time since the engine was last turned off, TC_SOAK_REU is a calibrateable time constant that describes the speed at which the heat applied to the rear post-catalyst EGO sensor will dissipate, EXT_REU_PREV is the temperature of the rear post-catalyst EGO sensor in an unheated state from the previous background loop and FNEXP(x) is a lookup table representing the constant e raised to the x.

5. A method of determining the temperature of an exhaust gas oxygen (EGO) sensor used with a heater in an electronic engine control for an engine having an exhaust utilizing a background loop including:

determining whether the temperatures of the EGO sensors have been initialized;

if the temperatures of the EGO sensors have not been initialized, initializing the temperature of the EGO sensors;

inferring the temperature of the EGO sensor by calculating a rolling average of the steady state temperature of the EGO sensor and a time constant which describes the speed at which the heat from the exhaust of a running engine will change the temperature of the tip of the EGO sensor;

determining whether the EGO sensor heater is on;

if the EGO sensor heater is not on, setting the amount of heat applied to the sensor to zero;

if the EGO sensor heater is on, finding the amount of applied heat by using a linear equation versus the EGO sensor temperature when the EGO sensor is in an unheated state;

determining the speed at which the EGO sensor tip will heat up using a calibrateable constant;

inferring the temperature of the EGO sensor in the unheated state by calculating the rolling average of the amount of heat that was applied to the tip of the EGO sensor and the time constant which describes the speed at which the EGO sensor will heat in the exhaust of a running engine;

inferring the temperature of the EGO sensor by adding the temperature increase due to the applied heat to the temperature of the EGO sensor in the unheated state; and updating the stored value of the temperature of the EGO sensor in the unheated state from the previous background loop with the temperature of the unheated EGO sensor from the current background loop.

6. A method of determining the temperature of an exhaust gas oxygen sensor as recited in claim 5 further including the steps of:

determining the initial temperature of a front pre-catalyst EGO sensor in the unheated state utilizing the following formula: INFAMB+FNEXP(−SOAKTIME/TC_SOAK_FEU) * (EXT_FEU_PREV−INFAMB) where INFAMB is the inferred ambient temperature in degrees, FNEXP(x) is a lookup table representing the constant e raised to the x, SOAKTIME is the amount of time in seconds that has lapsed since the engine was last turned off, TC_SOAK_FEU is a calibrateable time constant in degrees per second that describes the speed at which the front pre-catalyst EGO sensor in the unheated state (EXT_FEU) will cool off after the engine is turned off and EXT_FEU_PREV is the temperature in degrees of the front pre-catalyst EGO sensor in the unheated state from the previous background loop, before the engine was last turned off;

determining the amount of resistance heat remaining at the front pre-catalyst EGO tip utilizing the following formula: INFAMB+FNEXP(−SOAKTIME/TC_SOAK_FEH) * (EXT_FEH_PREV−INFAMB) where TC_SOAK_FEH is a calibrateable time constant in degrees per second that describes the speed at which the heat applied to front pre-catalyst EGO sensor will dissipate and EXT_FEH_PREV is the effect of the heat in degrees that was applied during the previous background loop;

determining the initial temperature of the tip of a heated front pre-catalyst EGO sensor utilizing the following formula: EXT_FEU+EXT_FEH where EXT_FEU is the temperature of the front pre-catalyst EGO sensor in the unheated state and EXT_FEH is the amount of heat applied to the front pre-catalyst EGO sensor by the resistance heater;

determining the initial temperature of a rear post-catalyst EGO sensor in the unheated state utilizing the following formula: INFAMB+FNEXP(−SOAKTIME/TC_SOAK_REU) * (EXT_REU_PREV−INFAMB) where INFAMB is the inferred ambient temperature in degrees, FNEXP(x) is a lookup table representing the constant e raised to the x, SOAKTIME is the amount of time in seconds that has lapsed since the engine was last turned off, TC_SOAK_REU is a calibrateable time constant in degrees per second that describes the speed at which the rear post-catalyst EGO sensor in the unheated state (EXT_REU) will cool off after the engine is turned off and EXT_REU_PREV is the temperature in degrees of rear post-catalyst EGO sensor in the unheated state from the previous background loop, before the engine was last turned off;

determining the amount of resistance heat remaining at the front pre-catalyst EGO tip utilizing the following formula: INFAMB+FNEXP(−SOAKTIME/TC_SOAK_REH) * (EXT_REH_PREV−INFAMB) where TC_SOAK_REH is a calibrateable time constant in degrees per second that describes the speed at which the heat applied to rear post-catalyst EGO sensor will dissipate and EXT_REH_PREV is the effect of the heat in degrees that was applied during the previous background loop; and determining the initial temperature of the tip of the rear post-catalyst EGO sensor utilizing the following formula: EXT_REU+EXT_REH where EXT_REU is the temperature of the rear post-catalyst EGO sensor in the unheated state and EXT_REH is the amount of heat applied to the rear post-catalyst EGO sensor by the resistance heater.

7. A method of determining the temperature of an exhaust gas oxygen sensor as recited in claim 5 further including:

calculating a temperature loss from a point near an exhaust flange to the EGO sensor utilizing the following formula: EXT_LS_FEU=FN443L(AM) * {(EXT_FL+EXT_FEU_PREV)/2−INFAMB} where FN443L(AM) is a table of temperature loss that is multiplied by the average of the exhaust flange temperature and the EGO sensor temperature from the previous background loop minus the inferred ambient temperature;

calculating the steady state temperature of the EGO sensor utilizing the following formula: EXT_SS_FEU=EXT_FL−EXT_LS_FEU where EXT_FL is the temperature of a point near the exhaust flange and EXT_LS_FEU is the temperature loss between the exhaust flange and the EGO sensor;

calculating the time constant that describes the speed at which the heat from the exhaust of a running engine will dissipate from the tip of the front pre-catalyst EGO sensor utilizing a lookup table which determines the time constant for instantaneous front pre-catalyst EGO sensor wall temperature versus air mass (AM); and calculating the rolling average of the steady state temperature of the front pre-catalyst EGO sensor in the unheated state and the effect of the heat of the exhaust of a running engine on the front pre-catalyst EGO sensor.

8. A method of determining the temperature of an exhaust gas oxygen (EGO) sensor as recited in claim 5 further including determining the amount of heat being applied to the tip of the front pre-catalyst EGO sensor utilizing a linear equation versus the front pre-catalyst EGO sensor temperature in the following formula: EXT_SS FEH=EXT_FEH_INT–EXT_FEH_SLP * EXT_FEU where EXT_FEH_INT is the intercept of the applied heat versus time, EXT_FEH_SLP is the slope of the applied heat versus time and EXT_FEU is the temperature of the front pre-catalyst EGO sensor in the unheated state.

9. A method of determining the temperature of an exhaust gas oxygen (EGO) sensor as recited in claim 5 further including determining the amount of heat being applied to the tip of the front pre-catalyst EGO sensor utilizing a table look up of the effect of the applied heat (EXT_SS_FEH) versus the temperature of the front pre-catalyst EGO sensor in the unheated state with piece-wise linear interpolation.

10. A method of determining the temperature of an exhaust gas oxygen (EGO) sensor as recited in claim 5 further including determining the speed pre-catalyst EGO sensor will heat utilizing a look up table versus air mass (AM).

11. A method of determining the temperature of an exhaust gas oxygen (EGO) sensor as recited in claim 5 further including determining the speed at which the front pre-catalyst EGO sensor will heat utilizing a look up table versus temperature of the front pre-catalyst EGO sensor in the unheated state.

12. A method of determining the temperature of an exhaust gas oxygen (EGO) sensor as recited in claim 5 further including:

calculating the rolling average of the magnitude of the amount of heat applied to the front pre-catalyst EGO sensor by the resistance heater utilizing the amount of heat applied to the front pre-catalyst EGO sensor and the speed at which the front pre-catalyst EGO sensor will heat up;

calculating the current temperature of the front pre-catalyst EGO sensor utilizing the following formula: EXT_FET=EXT_FEU+EXT_FEH where EXT_FEU is the temperature of the front pre-catalyst EGO sensor in the unheated state and EXT_FEH is the total amount of heat applied to the front pre-catalyst EGO sensor; and updating the value of the temperature of the front pre-catalyst EGO sensor in the unheated state from the previous background loop (EXT_FEU_PREV) with the temperature of the front pre-catalyst EGO sensor from the current background loop (EXT_FEU).

13. A method of determining the temperature of an exhaust gas oxygen (EGO) sensor as recited in claim 5 further including:

calculating the temperature loss from a point near a catalytic converter midbed in the engine exhaust to the EGO sensor utilizing the following formula: EXT_LS_REU=FN450L(AM) * {(EXT_CMD+EXT_REU_PREV)/2–INFAMB} where FN450L(AM) is a table of temperature loss that is multiplied by the average of the catalytic converter midbed temperature and the EGO sensor temperature from the previous background loop minus the inferred ambient temperature;

calculating the steady state temperature of the EGO sensor utilizing the following formula: EXT_SS_REU=EXT_CMD–EXT_LS_REU where EXT_CMD is the temperature of the catalytic converter midbed and EXT_LS_REU is the temperature loss between the catalytic converter midbed and the EGO sensor;

calculating the time constant that describes the speed at which the heat from the exhaust of a running engine will dissipate from the tip of the rear post-catalyst EGO sensor utilizing a lookup table which determines the time constant for instantaneous rear post-catalyst EGO sensor wall temperature versus air mass (AM); and calculating the rolling average of the steady state temperature of the unheated rear post-catalyst EGO sensor and taking into account the effect of the heat of the exhaust of a running engine on the rear post-catalyst EGO sensor.

14. A method of determining the temperature of an exhaust gas oxygen (EGO) sensor as recited in claim 5 further including determining the amount of heat being applied to the tip of the rear post-catalyst EGO sensor utilizing a linear equation versus the rear post-catalyst EGO sensor temperature in the following formula: EXT_SS_REH=EXT_REH_INT–EXT_REH_SLP * EXT_REU where EXT_REH_INT is the intercept of the applied heat versus time, EXT_REH_SLP is the slope of the applied heat versus time and EXT_REU is the temperature of the rear post-catalyst EGO sensor in the unheated state.

15. A method of determining the temperature of an exhaust gas oxygen (EGO) sensor as recited in claim 5 further including determining the amount of heat being applied to the tip of the rear post-catalyst EGO sensor utilizing a table look up of the effect of the applied heat (EXT_SS_REH) versus the temperature of the rear post-catalyst EGO sensor in the unheated state with piece-wise linear interpolation.

16. A method of determining the temperature of an exhaust gas oxygen (EGO) sensor as recited in claim 5 further including determining the speed post-catalyst EGO sensor will heat as recited in claim 5 utilizing a look up table versus air mass (AM).

17. A method of determining the temperature of an exhaust gas oxygen (EGO) sensor as recited in claim 5 further including determining the speed at which the rear post-catalyst EGO sensor will heat utilizing a look up table versus temperature of the rear post-catalyst EGO sensor in the unheated state.

18. A method of determining the temperature of an exhaust gas oxygen (EGO) sensor as recited in claim 5 further including:

calculating the rolling average of the heat applied to the rear post-catalyst EGO sensor by the resistance heater utilizing the amount of heat applied to the rear post-catalyst EGO sensor and the speed at which the rear post-catalyst EGO sensor will heat up;

calculating the current temperature of the rear post-catalyst EGO sensor utilizing the following formula: EXT_RET=EXT_REU+EXT_REH where EXT_REU is the temperature of the rear post-catalyst EGO sensor in the unheated state and EXT_REH is the total amount of heat applied to the rear post-catalyst EGO sensor; and updating the value of the temperature of the rear post-catalyst EGO sensor in the unheated state from the previous background loop (EXT_REU_PREV) with the temperature of the rear post-catalyst EGO sensor from the current background loop (EXT_REU).

19. A method of determining the temperature of an exhaust gas oxygen sensor as recited in claim 5 further including:

determining the initial temperature of the front pre-catalyst EGO sensor in the unheated state utilizing the following formula: INFAMB+FNEXP(−SOAKTIME/TC_SOAK_FEU) * (EXT_FEU_PREV−INFAMB) where INFAMB is the inferred ambient temperature in degrees, FNEXP(x) is a lookup table representing the constant e raised to the x, SOAKTIME is the amount of time in seconds that has lapsed since the engine was last turned off, TC_SOAK_FEU is a calibrateable time constant in degrees per second that describes the speed at which front pre-catalyst EGO sensor in the unheated state (EXT_FEU) will cool off after the engine is turned off and EXT_FEU_PREV is the temperature in degrees of front pre-catalyst EGO sensor in the unheated state from the previous background loop, before the engine was last turned off;

determining the amount of heat that was applied by the resistance heater to the front pre-catalyst EGO utilizing the following formula: INFAMB+FNEXP(−SOAKTIME/TC_SOAK_FEH) * (EXT_FEH_PREV−INFAMB) where TC_SOAK_FEH is a calibrateable time constant in degrees per second that describes the speed at which the heat applied to front pre-catalyst EGO sensor will dissipate and EXT_FEH_PREV is the effect of the heat in degrees that was applied during the previous background loop;

determining the initial temperature of the tip of the front pre-catalyst EGO sensor utilizing the following formula: EXT_FEU+EXT_FEH where EXT_FEU is the temperature of the front pre-catalyst EGO sensor in the unheated state and EXT_FEH is the amount of heat applied to the front pre-catalyst EGO sensor by the resistance heater;

determining the initial temperature of the rear post-catalyst EGO sensor in the unheated state utilizing the following formula: INFAMB+FNEXP(−SOAKTIME/TC_SOAK_REU) * (EXT_REU PREV−INFAMB) where INFAMB is the inferred ambient temperature in degrees, FNEXP(x) is a lookup table representing the constant e raised to the x, SOAKTIME is the amount of time in seconds that has lapsed since the engine was last turned off, TC_SOAK_REU is a calibrateable time constant in degrees per second that describes the speed at which rear post-catalyst EGO sensor in the unheated state (EXT_REU) will cool off after the engine is turned off and EXT_REU_PREV is the temperature in degrees of rear post-catalyst EGO sensor in the unheated state from the previous background loop, before the engine was last turned off;

determining the amount of heat that was applied by the resistance heater to the rear post-catalyst EGO utilizing the following formula: INFAMB+FNEXP(−SOAKTIME/TC_SOAK_REH) * (EXT_REH_PREV−INFAMB) where TC_SOAK_REH is a calibrateable time constant in degrees per second that describes the speed at which the heat applied to rear post-catalyst EGO sensor will dissipate and EXT_REH_PREV is the effect of the heat in degrees that was applied during the previous background loop;

determining the initial temperature of the tip of the rear post-catalyst EGO sensor utilizing the following formula: EXT_REU+EXT_REH where EXT_REU is the temperature of the rear post-catalyst EGO sensor in the unheated state and EXT_REH is the amount of heat applied to the rear post-catalyst EGO sensor by the resistance heater;

calculating a temperature loss from a point near an exhaust flange to the EGO sensor utilizing the following formula: EXT_LS_FEU=FN443L(AM) * {(EXT_FL+EXT_FEU_PREV)/2−INFAMB} where FN443L(AM) is a table of temperature loss that is multiplied by the average of the exhaust flange temperature and the EGO sensor temperature from the previous background loop minus the inferred ambient temperature;

calculating the steady state temperature of the EGO sensor utilizing the following formula: EXT_SS_FEU=EXT_FL−EXT_LS_FEU where EXT_FL is the temperature of a point near the exhaust flange and EXT_LS_FEU is the temperature loss between the exhaust flange and the EGO sensor;

calculating the time constant that describes the speed at which the heat from the exhaust of a running engine will dissipate from the tip of the front pre-catalyst EGO sensor utilizing a lookup table which determines the time constant for instantaneous front pre-catalyst EGO sensor wall temperature versus air mass (AM);

calculating the rolling average of the steady state temperature of the front pre-catalyst EGO sensor in the unheated state and the effect of the heat of the exhaust of a running engine on the front pre-catalyst EGO sensor;

determining the amount of heat being applied to the tip of the front pre-catalyst EGO sensor utilizing a linear equation versus the front pre-catalyst EGO sensor temperature in the following formula: EXT_SS_FEH=EXT_FEH_INT−EXT_FEH_SLP * EXT_FEU where EXT_FEH_INT is the intercept of the applied heat versus time, EXT_FEH_SLP is the slope of the applied heat versus time and EXT_FEU is the temperature of the front pre-catalyst EGO sensor in the unheated state;

determining the amount of heat being applied to the tip of the front pre-catalyst EGO sensor utilizing a table look up of the effect of the applied heat (EXT_SS_FEH) versus the temperature of the front pre-catalyst EGO sensor in the unheated state with piece-wise linear interpolation;

determining the speed at which the front pre-catalyst EGO sensor will heat utilizing a look up table versus air mass (AM);

determining the speed at which the front pre-catalyst EGO sensor will heat utilizing a look up table versus temperature of the front pre-catalyst EGO sensor in the unheated state;

calculating the rolling average of the magnitude of the amount of heat applied to the front pre-catalyst EGO sensor by the resistance heater utilizing the amount of heat applied to the front pre-catalyst EGO sensor and the speed at which the front pre-catalyst EGO sensor will heat up;

calculating the current temperature of the front pre-catalyst EGO sensor utilizing the following formula: EXT_FET=EXT_FEU+EXT_FEH where EXT_FEU is the temperature of the front pre-catalyst EGO sensor in the unheated state and EXT_FEH is the total amount of heat applied to the front pre-catalyst EGO sensor;

updating the value of the temperature of the front pre-catalyst EGO sensor in the unheated state from the previous background loop (EXT_FEU_PREV) with the temperature of the front pre-catalyst EGO sensor from the current background loop (EXT_FEU);

calculating the temperature loss from a point near a catalytic converter midbed in the engine exhaust to the EGO sensor utilizing the following formula: EXT_LS_REU=FN450L(AM) * {(EXT_CMD+EXT_REU_PREV)/2–INFAMB} where FN450L(AM) is a table of temperature loss that is multiplied by the average of the catalytic converter midbed temperature and the EGO sensor temperature from the previous background loop minus the inferred ambient temperature;

calculating the steady state temperature of the EGO sensor utilizing the following formula: EXT_SS_REU=EXT_CMD–EXT_LS_REU where EXT_CMD is the temperature of the catalytic converter midbed and EXT_LS_REU is the temperature loss between the catalytic converter midbed and the EGO sensor;

calculating the time constant that describes the speed at which the heat from the exhaust of a running engine will dissipate from the tip of the rear post-catalyst EGO sensor utilizing a lookup table which determines the time constant for instantaneous rear post-catalyst EGO sensor wall temperature versus air mass (AM);

calculating the rolling average of the steady state temperature of the rear post-catalyst EGO sensor in the unheated state and taking into account the effect of the heat of the exhaust of a running engine on the rear post-catalyst EGO sensor;

determining the amount of heat being applied to the tip of the rear post-catalyst EGO sensor utilizing a linear equation versus the rear post-catalyst EGO sensor temperature in the following formula: EXT_SS_REH=EXT_REH_INT–EXT_REH_SLP * EXT_REU where EXT_REH_INT is the intercept of the applied heat versus time, EXT_REH_SLP is the slope of the applied heat versus time and EXT_REU is the temperature of the rear post-catalyst EGO sensor in the unheated state;

determining the amount of heat being applied to the tip of the rear post-catalyst EGO sensor utilizing a table look up of the effect of the applied heat (EXT_SS_REH) versus the temperature of the rear post-catalyst EGO sensor in the unheated state with piece-wise linear interpolation;

determining the speed at which the rear post-catalyst EGO sensor will heat as recited in claim 5 utilizing a look up table versus air mass (AM);

determining the speed at which the rear post-catalyst EGO sensor will heat utilizing a look up table versus temperature of the rear post-catalyst EGO sensor in the unheated state;

calculating the rolling average of the heat applied to the rear post-catalyst EGO sensor by the resistance heater utilizing the amount of heat applied to the rear post-catalyst EGO sensor and the speed at which the rear post-catalyst EGO sensor will heat up;

calculating the current temperature of the rear post-catalyst EGO sensor utilizing the following formula: EXT_RET=EXT_REU+EXT_REH where EXT_REU is the temperature of the rear post-catalyst EGO sensor in the unheated state and EXT_REH is the total amount of heat applied to the rear post-catalyst EGO sensor; and updating the value of the temperature of the rear post-catalyst EGO sensor in the unheated state from the previous background loop (EXT_REU_PREV) with the temperature of the rear post-catalyst EGO sensor from the current background loop (EXT_REU).

* * * * *